US005769471A

United States Patent [19]

Suzuki et al.

[11] Patent Number: 5,769,471

[45] Date of Patent: Jun. 23, 1998

[54] APPARATUS FOR UNLOCKING A DOOR LOCK FOR A VEHICLE

[75] Inventors: Yasuaki Suzuki, Kariya; Naofumi Fujie, Nagoya; Toshimitsu Oka, Okazaki; Kazunori Sakamoto, Chiryu; Kouji Aoki, Nagoya; Osamu Fujimoto, Nisshin; Yutaka Kondoh; Masahiro Miyaji, both of Toyota, all of Japan

[73] Assignees: Aisin Seiki Kabushiki Kaisha; Toyota Jidosha Kabushiki Kaisha, both of Japan

[21] Appl. No.: 706,939

[22] Filed: Sep. 3, 1996

[30] Foreign Application Priority Data

Sep. 4, 1995 [JP] Japan ..... 7-251838

[51] Int. Cl.[6] ..... E05B 3/00

[52] U.S. Cl. ..... 292/336.3; 292/216; 292/DIG. 22

[58] Field of Search ..... 292/336.3, DIG. 22, 292/216, DIG. 23

[56] References Cited

U.S. PATENT DOCUMENTS

| | | | |
|---|---|---|---|
| 3,719,248 | 3/1973 | Breitschwerdt et al. | 292/DIG. 22 X |
| 3,799,596 | 3/1974 | Nozomu et al. | 292/216 |
| 3,858,921 | 1/1975 | Kuki | 292/336.3 |
| 3,990,531 | 11/1976 | Register | 292/DIG. 22 X |
| 4,536,021 | 8/1985 | Mochida | 292/DIG. 22 X |
| 5,613,717 | 3/1997 | Ha | 292/336.3 |

FOREIGN PATENT DOCUMENTS

| | | | |
|---|---|---|---|
| 2228384 | 11/1974 | France | 292/DIG. 22 |
| 1816942 | 7/1970 | Germany . | |
| 2946095 | 5/1981 | Germany | 292/DIG. 22 |
| 3100772 A1 | 1/1982 | Germany . | |
| 58-11275 | 1/1983 | Japan . | |
| 3-279573 | 12/1991 | Japan . | |
| 6-146688 | 5/1994 | Japan . | |

*Primary Examiner*—Rodney M. Lindsey
*Attorney, Agent, or Firm*—Finnegan, Henderson, Farabow, Garrett, & Dunner, L.L.P.

[57] ABSTRACT

An apparatus for unlocking a door lock for a vehicle, comprising a plurality of door locks for being mounted on doors of the vehicle, a collision direction detecting device for detecting a direction of an impact applied to a vehicle; and an unlocking mechanism for unlocking a door lock located on a side opposite to a collision side based on the direction detected by the collision direction detecting device.

20 Claims, 13 Drawing Sheets

* T1 : LOCK PROHIBITED PERIOD AFTER DETECTION OF CRASH

* T2 : LOCKING RELAY DRIVE PERIOD

APPARATUS FOR UNLOCKING A DOOR LOCK FOR A VEHICLE

BACKGROUND OF THE INVENTION

1. Field of the Invention

The present invention relates to an apparatus for unlocking a door lock for a vehicle, in which collision direction detecting means detects a side of a vehicle on which a collision has occurred, and an unlocking mechanism unlocks a door located on a side opposite to the detected collision side.

2. Description of the Prior Art

In a conventional door unlocking apparatus (Japanese Patent Application Laid-Open No. (kokai) 58-11275) shown in FIG. 16, when a vehicle undergoes a collision, an inertia lever L swings in the clockwise direction due to inertial force of a weight W disposed at the lower end of the inertia lever L. As a result, a bell crank B is swung in the clockwise direction so that all the doors are unlocked via an intermediate rod R, thereby allowing vehicle occupants to be rescued.

In the conventional door unlocking apparatus, even a door close to a position where a collision has occurred is unlocked. Therefore, there is a possibility that a door close to a position where a collision has occurred cannot be unlocked smoothly due to the impact of the collision, or the door cannot be unlocked at all. Accordingly, the conventional door unlocking apparatus has a drawback that it carries out considerably useless operations.

SUMMARY OF THE INVENTION

It is a primary object to smoothly and securely unlock a door lock located on a side opposite to a collision side of a vehicle.

It is another object to rescue vehicle occupants when a collision of a vehicle occurs.

It is a further object to provide a door unlocking apparatus based on a technical idea of unlocking a door lock located on a side opposite to a collision side of a vehicle.

It is a still further object to provide an apparatus for unlocking a door lock for a vehicle, comprising: a plurality of door locks for being mounted on doors of the vehicle; collision direction detecting means for detecting a direction of an impact applied to the vehicle; and an unlocking mechanism for unlocking a door lock mounted on a side opposite to a collision side based on the direction detected by the collision direction detecting means.

It is a still further object to provide an apparatus for unlocking a door lock for a vehicle wherein the collision direction detecting means detects an impact on the front side or rear side of the vehicle.

It is a yet further object to provide an apparatus for unlocking a door lock for a vehicle wherein the collision direction detecting means detects an impact on the left side or right side of the vehicle.

It is a yet further object to provide an apparatus for unlocking a door lock for a vehicle wherein the collision direction detecting means comprises a collision detecting mechanism including a plurality of movable members which correspond to sides at each of which a collision will occur and which moves due to an impact caused by a collision of the vehicle, and that the movement of the movable member is transmitted to the unlocking mechanism located at a side opposite to a collision side.

It is another object to provide an apparatus for unlocking a door lock for a vehicle wherein the moving member comprises a swing member which has a weight functioning as an inertia mass at the time of a collision of the vehicle, and which swings about a single supporting point in the direction of an inertial force opposite to the direction of the impact of the collision.

It is a still further object to provide an apparatus for unlocking a door lock for a vehicle the collision direction detecting means comprises an acceleration sensor for detecting the direction of an impact acceleration when a collision of the vehicle occurs.

It is a yet further object to provide an apparatus for unlocking a door lock for a vehicle wherein the unlocking mechanism comprises a controller which outputs, in accordance with the direction of the impact acceleration detected by the acceleration sensor, an unlocking signal for unlocking a lock condition of a door lock located on a side opposite to a collision side, and a door control motor which responds to the unlocking signal from the controller so as to unlock the door lock located on the side opposite to the collision side.

In the apparatus for unlocking a door lock for a vehicle according to the present invention and having the above-described structure, when the vehicle encounters a collision, the collision direction detecting means detects the direction of an impact applied to the vehicle, and the unlocking mechanism unlocks the door lock located on the side opposite to the detected collision side based on the direction detected by the collision direction detecting means.

In the apparatus for unlocking a door lock for a vehicle according to the present invention and having the above-described structure, when the vehicle encounters a collision, the direction detecting means detects the impact on the front side or rear side of the vehicle.

In the apparatus for unlocking a door lock for a vehicle according to the present invention and having the above-described structure, when the vehicle encounters a collision, the direction detecting means detects the impact on the left side or right side of the vehicle.

In the apparatus for unlocking a door lock for a vehicle according to the present invention and having the above-described structure, when the vehicle encounters a collision, among the plurality of movable members constituting the collision direction detecting means, one movable member moves in accordance with the direction of the impact of the collision, and the movement of the movable member is transmitted to the unlocking mechanism located on the side opposite to the collision side, so that the door located on the side opposite to the collision side is unlocked.

In the apparatus for unlocking a door lock for a vehicle according to the present invention and having the above-described structure, when the vehicle encounters a collision, the swing member, which constitutes the movable member and which has the weight functioning as the inertia mass at the time of the collision of the vehicle, swings about the single supporting point in the direction of an inertial force opposite to the direction of the impact of the collision. As a result, the movement of the swing member is transmitted to the unlocking mechanism of the door lock located on the side opposite to the collision side, so that the door located on the side opposite to the collision side is unlocked.

In the apparatus for unlocking a door lock for a vehicle according to the present invention and having the above-described structure, the acceleration sensor constituting the collision direction detecting means detects the direction of an impact acceleration when a collision of the vehicle occurs, and the controller constituting the unlocking mechanism outputs, in accordance with the direction of the impact acceleration detected by the acceleration sensor, an unlocking signal for unlocking the lock condition of the door lock located on the side opposite to the collision side. The door control motor responds to the unlocking signal from the controller so as to unlock the door lock located on the side opposite to the collision side.

In the apparatus for unlocking a door lock for a vehicle according to the present invention and performing the above-described action, a door lock located on the side opposite to the collision side detected by the collision direction detecting means is unlocked by the unlocking mechanism. Accordingly, the apparatus according to the first aspect has an effect of making it possible to smoothly and securely unlock a door lock located on the side opposite to the collision side and thus making it possible to rescue vehicle occupants.

In the apparatus for unlocking a door lock for a vehicle according to the present invention and performing the above-described action, the rear-side or front-side door lock located on the side opposite to the collision side detected by the front/rear direction detecting means is unlocked by the front/rear unlocking mechanism. Accordingly, the apparatus according to the second aspect has an effect of making it possible to smoothly and securely unlock the rear-side or front-side door lock located on the side opposite to the collision side and thus making it possible to rescue vehicle occupants.

In the apparatus for unlocking a door lock for a vehicle according to the present invention and performing the above-described action, the right-side or left-side door lock located on the side opposite to the collision side detected by the right/left direction detecting means is unlocked by the right/left unlocking mechanism. Accordingly, the apparatus according to the third aspect of the present invention has an effect of making it possible to smoothly and securely unlock the right-side or left-side door lock located on the side opposite to the collision side and thus making it possible to rescue vehicle occupants.

In the apparatus for unlocking a door lock for a vehicle according to the present invention and performing the above-described action, one movable member moves in accordance with the direction of the impact of the collision, and the movement of the movable member is transmitted to the unlocking mechanism of a door lock located on the side opposite to the collision side, so that the door lock located on the side opposite to the collision side is unlocked. Accordingly, in addition to the effect of the first aspect, the apparatus according to the fourth aspect has an effect of making it possible to unlock the door lock located on the side opposite to the collision side by a simple structure.

In the apparatus for unlocking a door lock for a vehicle according to the present invention and performing the above-described action, the swing member, which has the weight functioning as an inertia mass at the time of a collision of the vehicle, swings about the single supporting point in the direction of the inertial force opposite to the direction of the impact of the collision, and unlocks the door lock located on the side opposite to the collision side via the connection member. Accordingly, in addition to the effect of the fourth aspect, the apparatus according to the fifth aspect has an effect of securely performing the detection of the collision side of the vehicle, and the cancellation of the locked state, because the swing member has the weight.

In the apparatus for unlocking a door lock for a vehicle according to the present invention and performing the above-described action, only when the inertial force of the weight functioning as the inertia mass becomes greater than the urging force in the opposite to direction produced by the spring member, the swing member swings so as to unlock the door lock located on the side opposite to the collision side. This prevents the door lock from being unlocked due to quick acceleration, quick stop, quick turn, very light hit, or the like, and allows the door to be unlocked only when the vehicle receives the impact equal to or greater than the predetermined level produced by the collision of the vehicle. Accordingly, in addition to the effect of the fifth aspect, the apparatus according to the sixth aspect has an effect of preventing erroneous operations.

In the apparatus for unlocking a door lock for a vehicle according to the present invention and performing the above-described action, the controller outputs, in accordance with the direction of the impact acceleration detected by the acceleration sensor, an unlocking signal for unlocking the door lock located on the side opposite to the collision side, and the door control motor responds to the unlocking signal from the controller so as to unlock the door lock located on the side opposite to the collision side. Accordingly, the apparatus according to the seventh aspect has an effect of making it possible to unlock a door lock located on the side opposite to the collision side, only by adding the acceleration sensor and by partially modifying the control program.

DETAILED DESCRIPTION OF PREFERRED EMBODIMENTS

Figure 1:
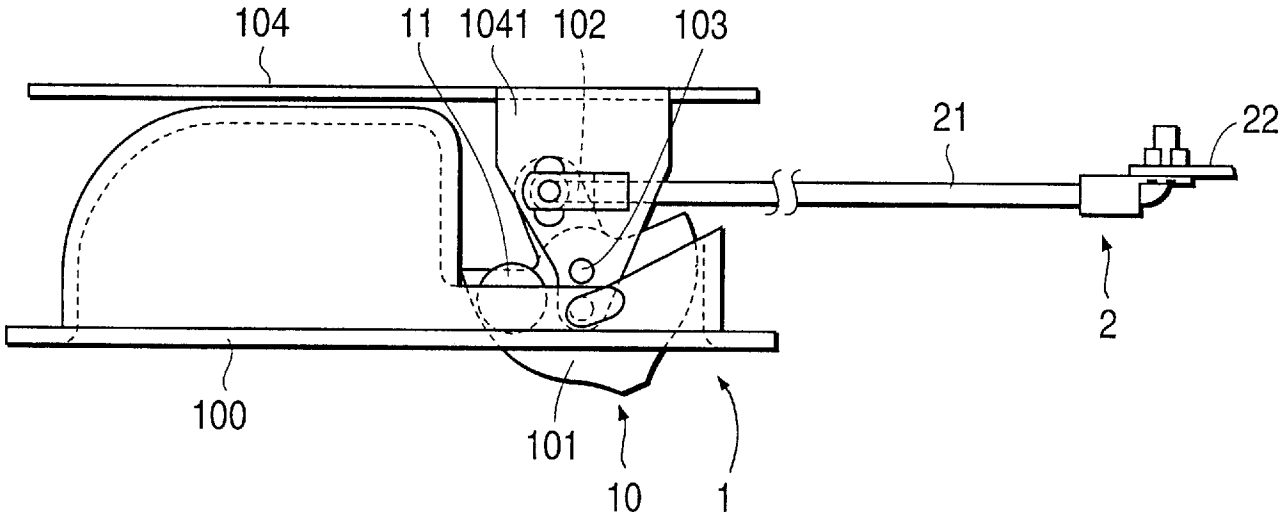
FIG. 1 is a plan view showing a main portion of an apparatus according to a first embodiment of the present invention.

Embodiments of the present invention will now be described with reference to the drawings.

(First Embodiment)

As shown in FIGS. 1–4, an apparatus for unlocking a door lock for a vehicle according to a first embodiment comprises a collision direction detecting mechanism 1 and a door unlocking mechanism 2, which are provided in each of doors of a vehicle, which are disposed at four openings of the vehicle located at the front-left, front-right, rear-left and rear-right of the vehicle such that they can be opened and closed. The collision direction detecting mechanism 1 comprises a door lock knob 10 which has a weight 11 functioning as an inertia mass and which is swingably supported so as to serve as a swing member. The door unlocking mechanism 2 comprises a bell crank 22 and adapted to transmit movement of the door lock knob 10 to a door lock 3 when a collision occurs.

Figure 2:
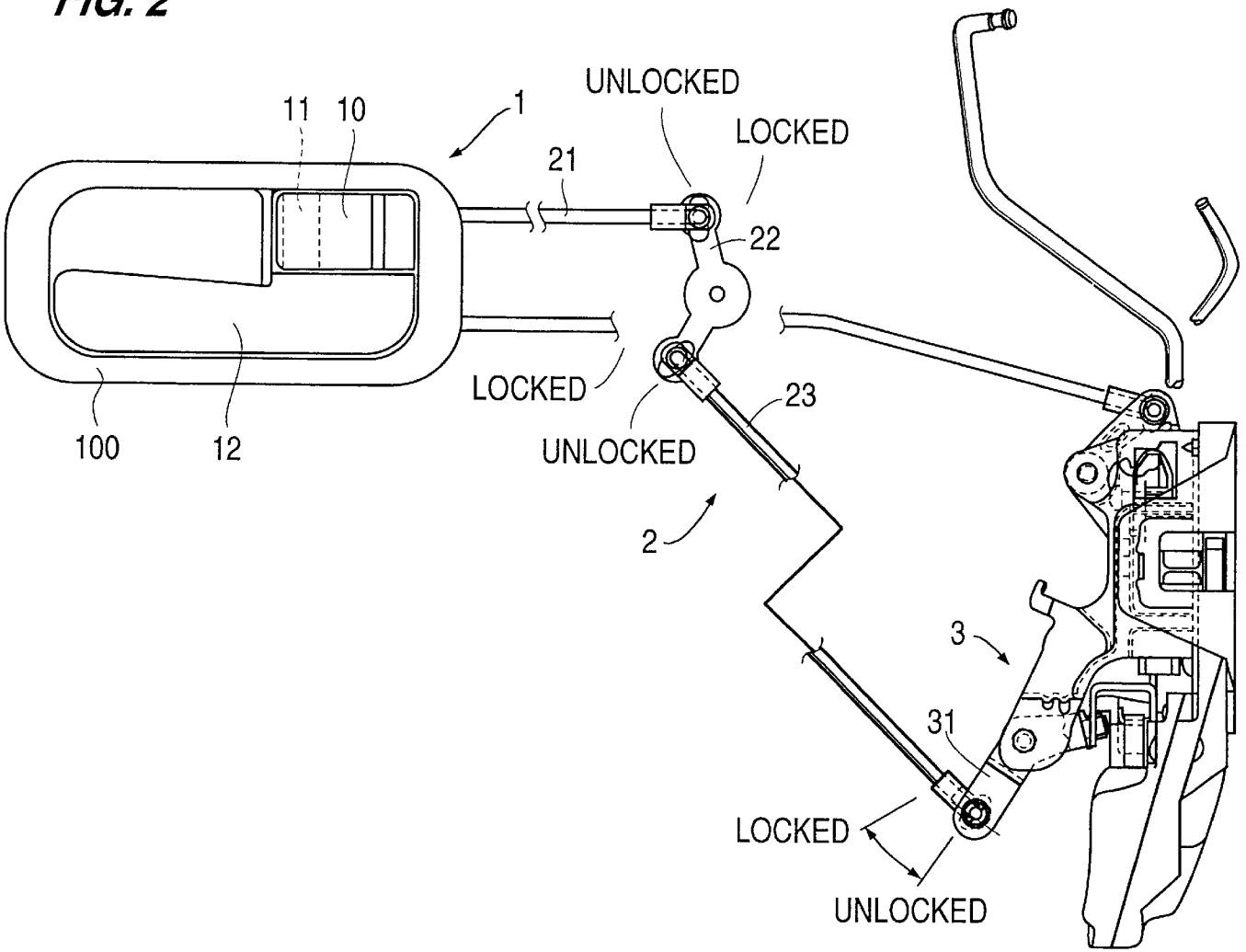
FIG. 2 is a side view showing the entire apparatus according to the first embodiment.

As shown in FIGS. 1 and 2, the door lock knob 10 constituting the collision direction detecting mechanism 1 is disposed within an inside handle bezel 100 together with a door handle 12 to be parallel thereto. The door lock knob 10 comprises a generally semicircular head portion 101 and a stem portion 102 and has a mushroom-like cross section.

As shown in FIGS. 1 and 2, the door lock knob 10 is swingably supported, at the connecting portion between the head portion 101 and the stem portion 102, by a vertically disposed pin 103. Both ends of the pin 103 are supported by flanges 1041, which are integrally provided on a door inside handle base plate 104 such that the flanges 1041 are located at the upper and lower positions in the inside handle bezel 100. A locked position and an unlocked positions are set at both ends of swing movement of the door lock knob 10.

A cylindrical weight 11 made of a metal and having an adjusted weight is disposed at one side of the head portion 101 of the door lock knob 10 such that the weight 11 can act as an inertia mass. When another vehicle or the like hits against the left side of the vehicle, the door lock knob 10 is swung in the counterclockwise direction in FIGS. 1 and 3 due to the inertial force of the weight 11 so as to unlock the right-side door.

Figure 3:
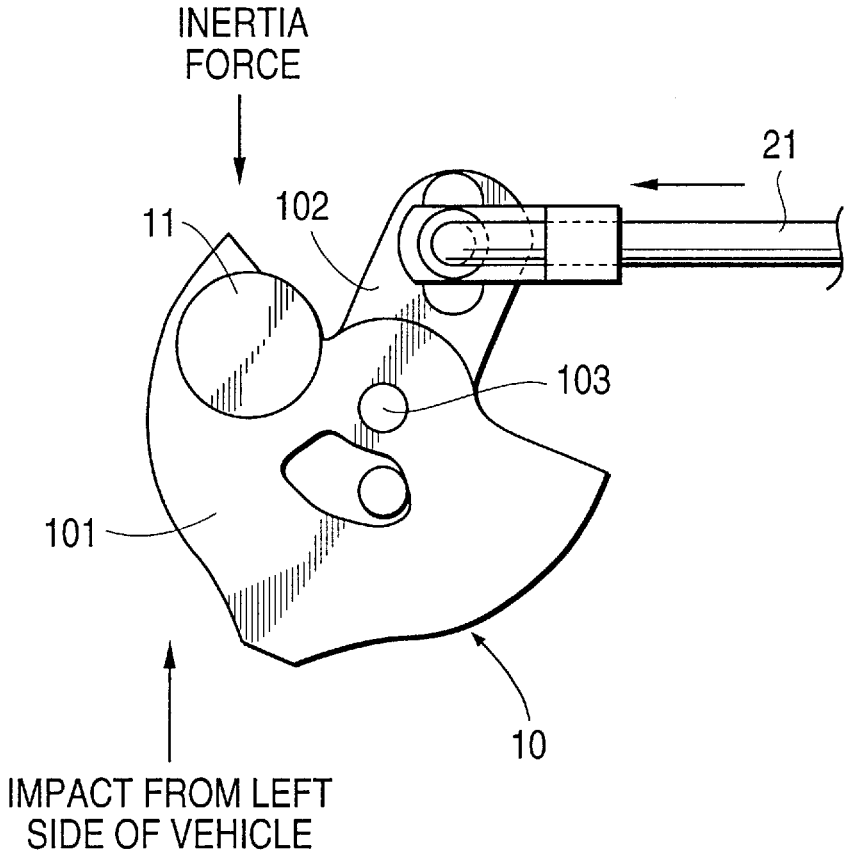
FIG. 3 is a partial plan view of a collision direction detecting mechanism according to the first embodiment showing its locked state.

In contrast, when another vehicle or the like hits against the right side of the vehicle, the door lock knob 10 in the locked state is swung in its locking direction, i.e., in the clockwise direction in FIG. 3 due to the inertial force of the weight 11. Therefore, the door lock knob 10 does not move.

The door unlocking mechanism 2 comprises a link 21 whose one end is connected to the door lock knob 10, a V-shaped bell crank 22 whose one end is connected to the other end of the link 21 and which is swingably supported by the door, and a link 23 which is connected to the other end of the bell crank 22 and whose other end is connected to a lock lever 31 of the door lock 3.

Figure 4:
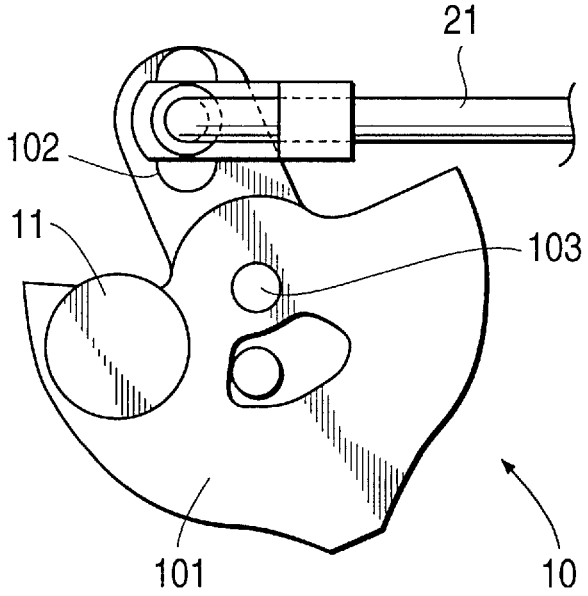
FIG. 4 is a partial plan view of the collision direction detecting mechanism according to the first embodiment showing its unlocked state.

In the apparatus for unlocking a door lock for a vehicle according to the first embodiment having the above-described structure, when another vehicle or the like hits against the left side of the vehicle, the door lock knob 10 of a right-side door of the vehicle is swung due to the inertia of the weight 11, so that the door lock knob 10 swings in the counterclockwise direction from the locked position to the unlocked position, i.e., the door lock knob 10 is brought from the state of being swung toward the front of the vehicle (state shown in FIG. 3) into the state of being swung toward the back of the vehicle (state shown in FIG. 4).

When the door lock knob 10 swings in the counterclockwise direction in FIG. 3, the link 21, which constitutes the door unlocking mechanism 2 and whose one end is connected to the door lock knob 10, is moved leftward in FIG. 3. As a result, the V-shaped bell crank 22, whose one end is connected to the other end of the link 21 and which is swingably supported by the door, swings in the counterclockwise direction.

When the bell crank 22 swings in the counterclockwise direction, the link 23, which is connected to the other end of the bell crank 22 and whose other end is connected to the door lock 3 is obliquely moved downward in FIG. 2, so that the door lock 3 of the right-side door of the vehicle is brought from the locked state into the unlocked state (i.e., the locked state is canceled).

When another vehicle or the like hits against the right side of the vehicle, the door lock knob 10 of a left-side door of the vehicle is swung due to the inertia of the weight 11, as in the above-described case, so that the door lock 3 of the left-side door of the vehicle is brought from the locked state into the unlocked state (i.e., the locked state is canceled) via the link 21, the bell crank 22, the link 23, and the lock lever 31.

When another vehicle or the like hits against the right side of the vehicle, the door lock knob 10 in the locked state is swung in the locking direction, i.e., in the clockwise direction in FIG. 3 due to the inertial force of the weight 11. Therefore, the door lock knob 10 does not move, so that the door lock knob 10 is prevented from affecting the door lock 3 via the door unlocking mechanism 2.

In the apparatus for unlocking a door lock for a vehicle according to the first embodiment, which performs the above-described action, the door lock 3 of a right-side or left-side door located on a side opposite to the collision side detected by the collision direction detecting means 1 for detecting left-side and right-side collisions is unlocked by the door unlocking mechanism. Accordingly, the apparatus according to the first embodiment has an effect of making it possible to smoothly and securely unlock a right-side or left-side door located on a side opposite to the collision side and thus making it possible to rescue vehicle occupants.

In the apparatus for unlocking a door lock for a vehicle according to the first embodiment, the door lock knob 10, which has a T-shaped cross section and functions as a swing member, swings in the direction opposite to the direction of the impact of a collision of the vehicle, and cancels the locked state of the door lock 3 of a door located on the side opposite to the collision side, via the link 21, the bell crank 22, and the link 23. Accordingly, the apparatus according to the present embodiment has an effect of making it possible to unlock a door lock located on the side opposite to the collision side by a simple structure.

In the apparatus for unlocking a door lock for a vehicle according to the present embodiment, the door lock knob 10, which has the weight 11 functioning as an inertia mass at the time of a collision of the vehicle and which serves as the swing member, swings about the single supporting point in the direction of an inertial force opposite to the direction of the impact of the collision, and unlocks a door located on the side opposite to the collision side via the bell crank 22. Accordingly, the apparatus according to the present embodiment has an effect of securely performing the detection of a collision side of the vehicle, and the cancellation of a locked state, because the door lock knob 10 is provided with the weight 11.

In the present embodiment, the door lock knob 10 is indirectly urged, in the direction opposite to the direction of the inertial force of the weight 11 at the time of a collision of the vehicle, by the spring (not illustrated) which urges the locking lever 31 in the locking direction. However, it is possible to interpose a spring between the door lock knob 10 and the door so as to directly urge the door lock knob 10.

As described above, since the door lock knob 10 is urged by the spring in the direction opposite to the direction of the inertial force, the door is prevented from being unlocked due to quick acceleration, quick stop, quick turn, very light hit, or the like, and is unlocked only when the vehicle receives an impact equal to or greater than a predetermined level produced by a collision of the vehicle, Accordingly, the apparatus according to the present embodiment has an effect of preventing erroneous operations.

(Second Embodiment)

As shown in FIGS. 5–8, an apparatus for unlocking a door lock for a vehicle according to a second embodiment differs from the first embodiment in that a weight 11 is disposed on the lock lever 31, which serves as a swing member in the door lock 3 of each of front and rear doors of the vehicle, so as to constitute the collision direction detecting mechanism 1, thereby unlocking a lock condition of a door upon a front or rear collision of the vehicle. This difference will be mainly described hereinafter.

Figure 5:
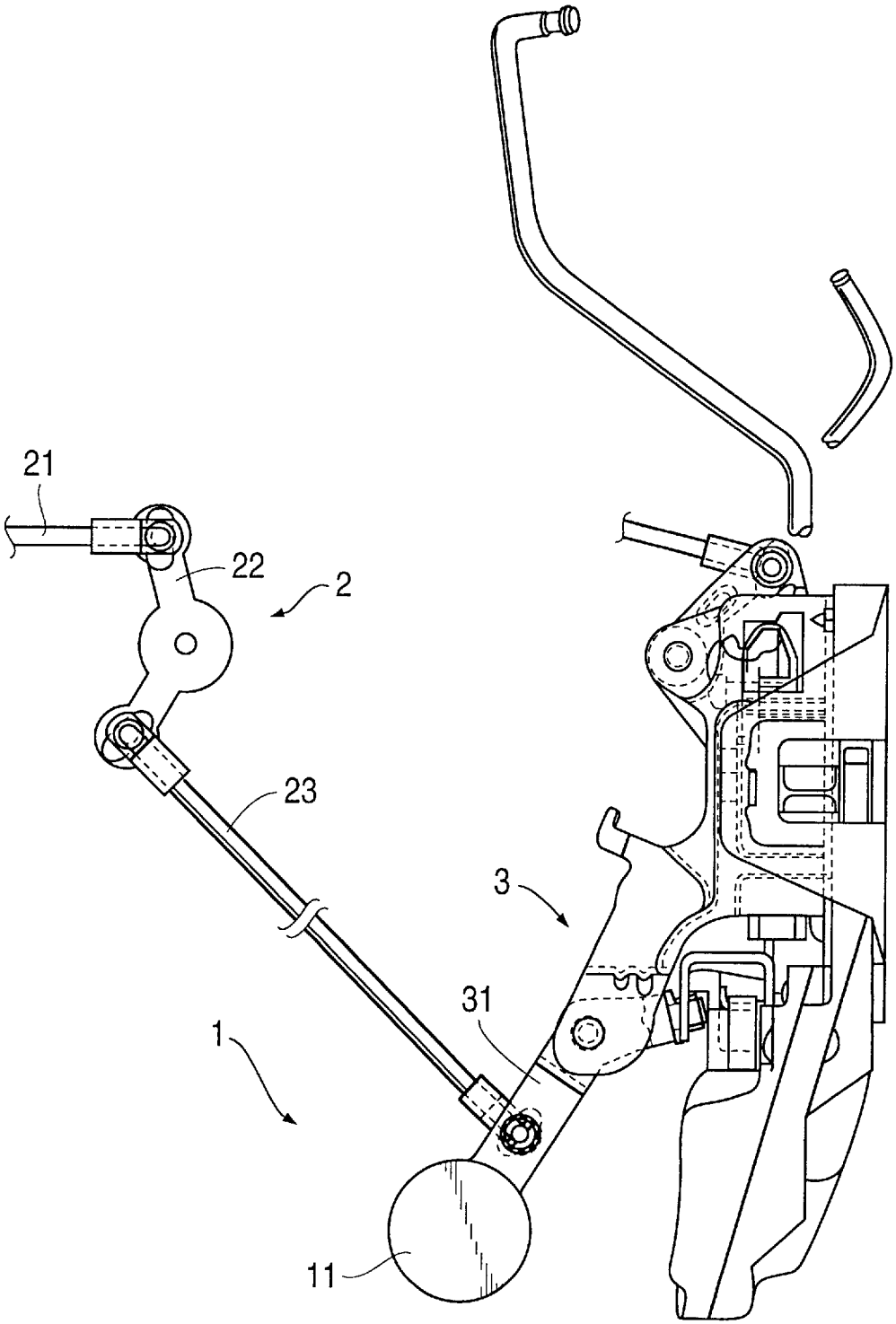
FIG. 5 is a side view of an apparatus according to a second embodiment of the present invention showing a state in which a front door is in the unlocked state.
Figure 6:
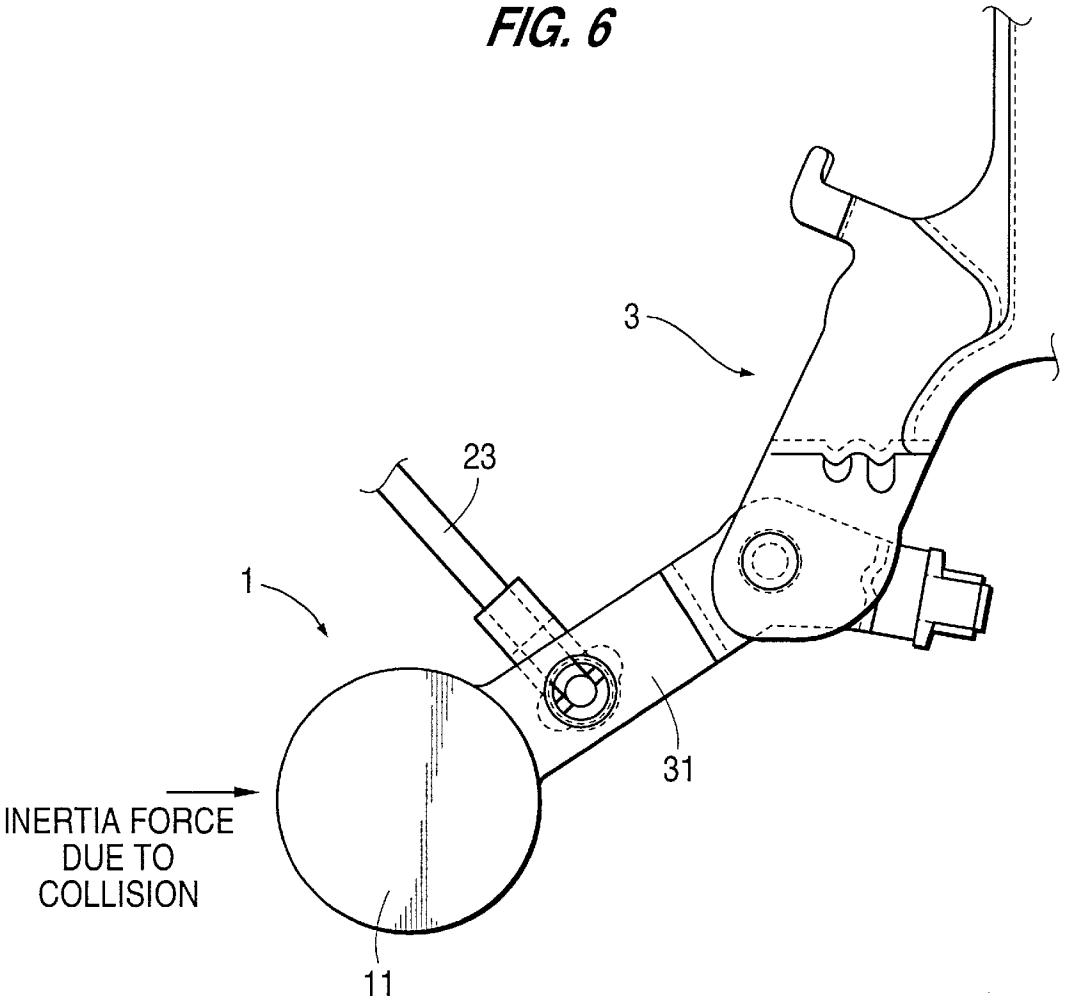
FIG. 6 is a partial side view of the apparatus according to the second embodiment showing a state in which the front door is in the locked state.

In each front door, as shown in FIGS. 5 and 6, the link 23 is engaged with the central portion of the lock lever 31, which swings about its upper end serving as a supporting point, and the weight 11 is attached to the lower end of the lock lever 31. One end of the bell crank 22 is connected to the rink 21 connected to the-above mentioned door lock knob (non-illustrated), and the link 23 is connected to the other end of the bell crank 22.

Figure 7:
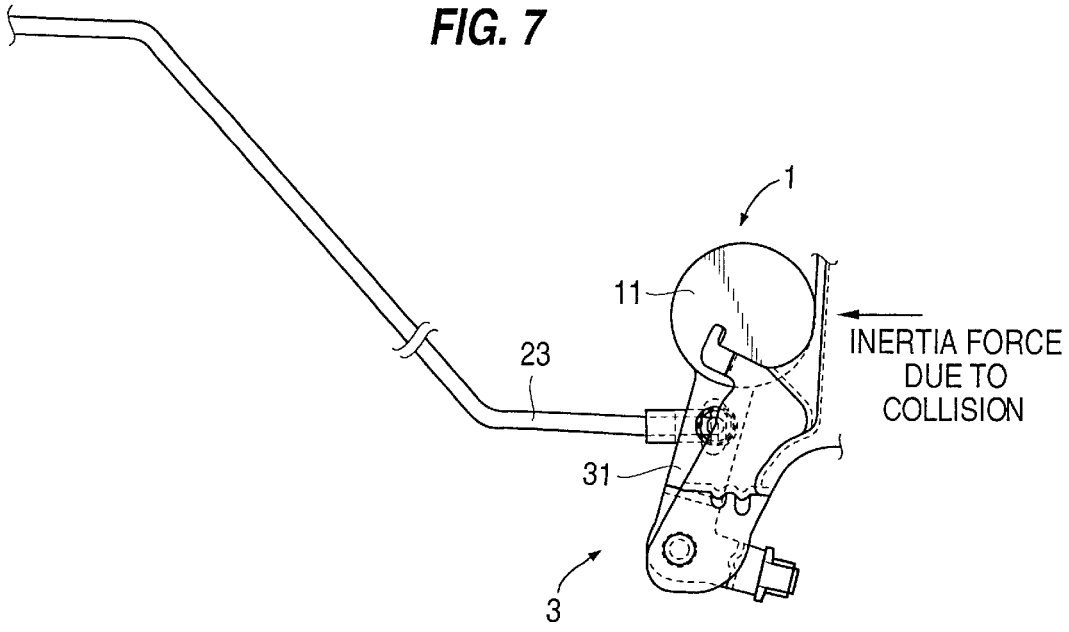
FIG. 7 is a partial side view of an apparatus according to the second embodiment of the present invention showing a state in which a rear door is in the locked state.
Figure 8:
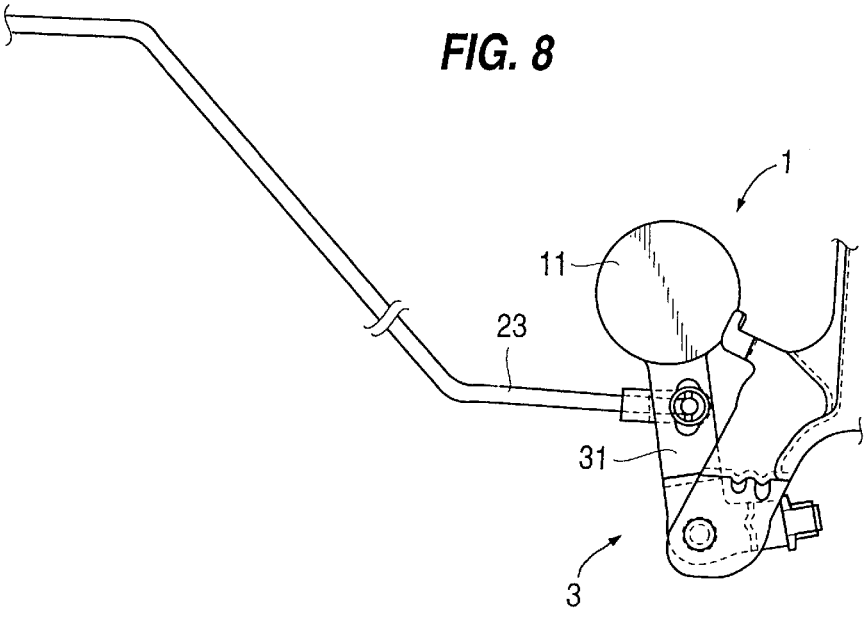
FIG. 8 is a partial side view of the apparatus according to the second embodiment showing a state in which the rear door is in the unlocked state.

In each rear door, as shown in FIGS. 7 and 8, the link 23 connected to the door lock knob is engaged with the central portion of the lock lever 31, which swings about its lower end serving as a supporting point, and the weight 11 is attached to the upper end of the lock lever 31.

In the apparatus for unlocking a door lock for a vehicle according to the second embodiment having the above-described structure, when another vehicle or the like hits against the back of the vehicle, the lock lever 31 having the weight 11 at its lower end swings counterclockwise about the upper end of the front door serving as a supporting point due to the inertia of the weight 11, so that the lock lever 31 is brought from the state shown in FIG. 6 to the state shown in FIG. 5. As a result, the front door is unlocked.

On the contrary, when another vehicle or the like hits against the front of the vehicle, the lock lever 31 having the weight 11 at its upper end swings counterclockwise about the lower end of the front door serving as a supporting point due to the inertia of the weight 11, so that the lock lever 31 is brought from the state shown in FIG. 7 to the state shown in FIG. 8. As a result, the rear door is unlocked.

In the apparatus for unlocking a door lock for a vehicle according to the second embodiment, which performs the above-described action, a front-side or rear-side door located on a side opposite to the collision side detected by the collision direction detecting means 1 for detecting front-side and rear-side crushes is unlocked. Accordingly, the apparatus according to the second embodiment has an effect of making it possible to smoothly and securely unlock a rear-side or front-side door located on a side opposite to the collision side and thus making it possible to rescue vehicle occupants.

In the apparatus for unlocking a door lock for a vehicle according to the second embodiment, the door lock lever 31, which is an element of the door lock, is directly swung by the weight 11 disposed at the tip end of the lock lever 31, due to the impact at the time of a collision of the vehicle, so as to cancel the locked state of the door lock 3. Accordingly, the apparatus according to the present embodiment has an effect of making it possible to unlock a door lock located on the side opposite to the collision side by a simple structure.

In the apparatus for unlocking a door lock for a vehicle according to the second embodiment, the lock lever 31, which has the weight 11 functioning as an inertia mass at the time of a collision of the vehicle, swings about the single supporting point in the direction of an inertial force opposite to the direction of the impact of the collision, and unlocks a door lock located on the side opposite to the collision side. Accordingly, the apparatus according to the present embodiment has an effect of securely performing the detection of a collision side of the vehicle, and the cancellation of a locked state, because the lock lever 31 has the weight 11.

(Third Embodiment)

Figure 9:
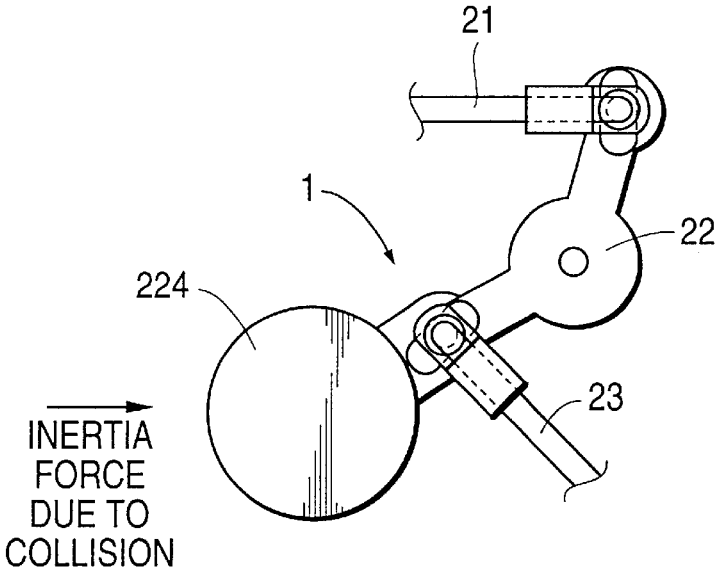
FIG. 9 is a partial side view of an apparatus according to a third embodiment of the present invention showing a state in which a front door in the locked state.
Figure 10:
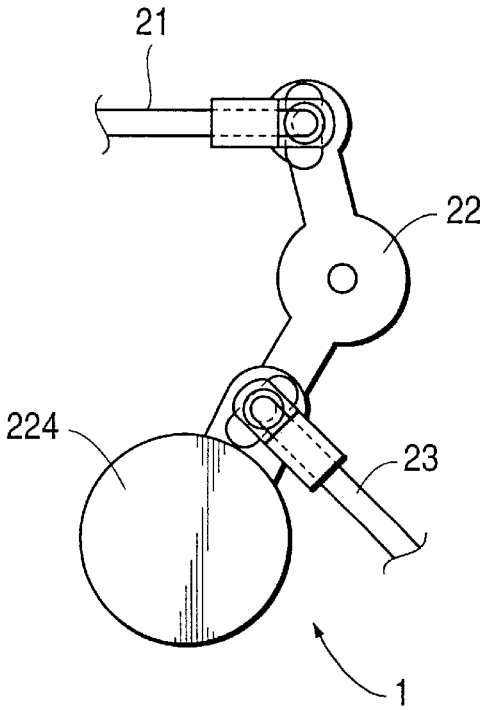
FIG. 10 is a partial plan view of the apparatus according to the third embodiment showing a state in which the front door in the unlocked state.

As shown in FIGS. 9 and 10, an apparatus for unlocking a door lock for a vehicle according to a third embodiment uses a bell crank 22, whose one end is connected to one end of the link 23 connected to the lock lever and which has a weight 224 at its other end, instead of the lock lever of the door lock provided with the weight, which is used in the second embodiment as a swing member for unlocking a front door. The bell crank 22 constitutes the swing member of the collision direction detecting mechanism 1.

In the apparatus for unlocking a door lock for a vehicle according to the third embodiment having the above-described structure, when another vehicle or the like hits against the back of the vehicle, the bell crank 22 is swung counterclockwise due to the inertia of the weight 224 at the time of the collision, so that the bell crank 22 is brought from the state shown in FIG. 9 to the state shown in FIG. 10. As a result, the door lock of the door is unlocked via the link 23.

As in the second embodiment, in the apparatus for unlocking a door lock for a vehicle according to the third embodiment, which performs the above-described action, a front-side or rear-side door located on a side opposite to the collision side detected by the collision direction detecting means 1 for detecting front-side and rear-side crushes is unlocked. Accordingly, the apparatus according to the present embodiment has an effect of making it possible to smoothly and securely unlock a rear-side or front-side door lock located on a side opposite to the collision side and thus making it possible to rescue vehicle occupants.

In the apparatus for unlocking a door lock for a vehicle according to the third embodiment, the locked state of the door lock is canceled by the weight 224 added to the lower end of the bell crank 22 due to the impact at the time of a collision of the vehicle. Accordingly, the apparatus according to the present embodiment has an effect of making it possible to unlock a door lock located on the side opposite to the collision side by a simple structure and through a slight modification.

In the apparatus for unlocking a door lock for a vehicle according to the third embodiment, the bell crank 22, which has the weight 224 functioning as an inertia mass at the time of a collision of the vehicle, swings about the single supporting point in the direction of an inertial force of the weight 224 opposite to the direction of the impact of the collision, and unlocks a door lock located on the side opposite to the collision side. Accordingly, the apparatus according to the present embodiment has an effect of securely performing the detection of a collision side of the vehicle, and the cancellation of a locked state.

(Fourth Embodiment)

Figure 11:
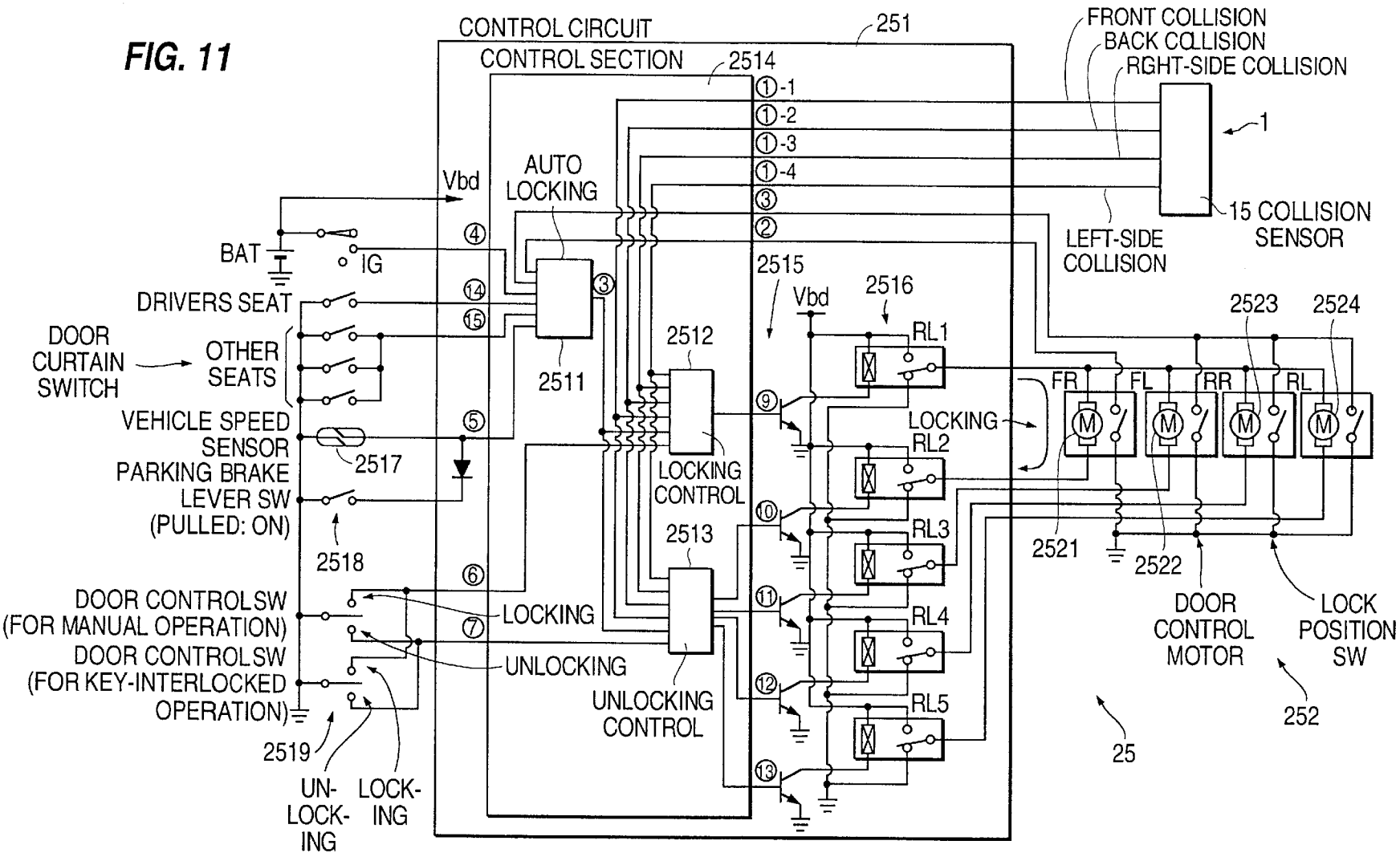
FIG. 11 is a block diagram of the overall structure of an apparatus according to a fourth embodiment of the present invention.

As shown in FIG. 11, in an apparatus for unlocking a door lock for a vehicle according to a fourth embodiment, the above-described collision direction detecting means 1 comprises an acceleration sensor 15 for detecting the direction of an impact acceleration when a collision of the vehicle occurs, and the above-described unlocking mechanism comprises a controller 251 which judges the direction of the impact acceleration detected by the acceleration sensor 15 and outputs an unlocking signal for unlocking a lock condition of a door located on a side opposite to the detected collision side, and a door control motor 252 which responds to the unlocking signal from the controller 251 so as to unlock the door lock located on the side opposite to the detected collision side.

As shown in FIG. 11, the acceleration sensor 15 comprises an acceleration sensor serving as a collision sensor for detecting a side on which a collision has occurred. Based on the direction of acceleration at the time of a collision, the following signals are output. When another vehicle or the like hits against the front of the vehicle, a front collision signal is output. When another vehicle or the like hits against the back of the vehicle, a back collision signal is output. When another vehicle or the like hits against the right side of the vehicle, a right-side collision signal is output. When another vehicle or the like hits against the left side of the vehicle, a left-side collision signal is output.

As shown in FIG. 11, the controller 251 includes a control section 2514 consisting of an auto-locking control section 2511, a locking control section 2512 and an unlocking control section 2513, a switch section 2515, and a relay section 2516. A vehicle speed sensor 2517, a parking brake switch 2518, a door control switch 2519, and the like are connected to the controller 251.

As shown in FIG. 11, the control motor 252 is each of a motor 2521 for the door lock of the front right door, a motor 2522 for the door lock of the front left door, a motor 2523 for the door lock of the rear right door, and a motor 2524 for the door lock of the rear left door, which are connected to the respective relays of the relay section 2516. Each of the motors locks and unlocks the corresponding door lock.

Figure 12:
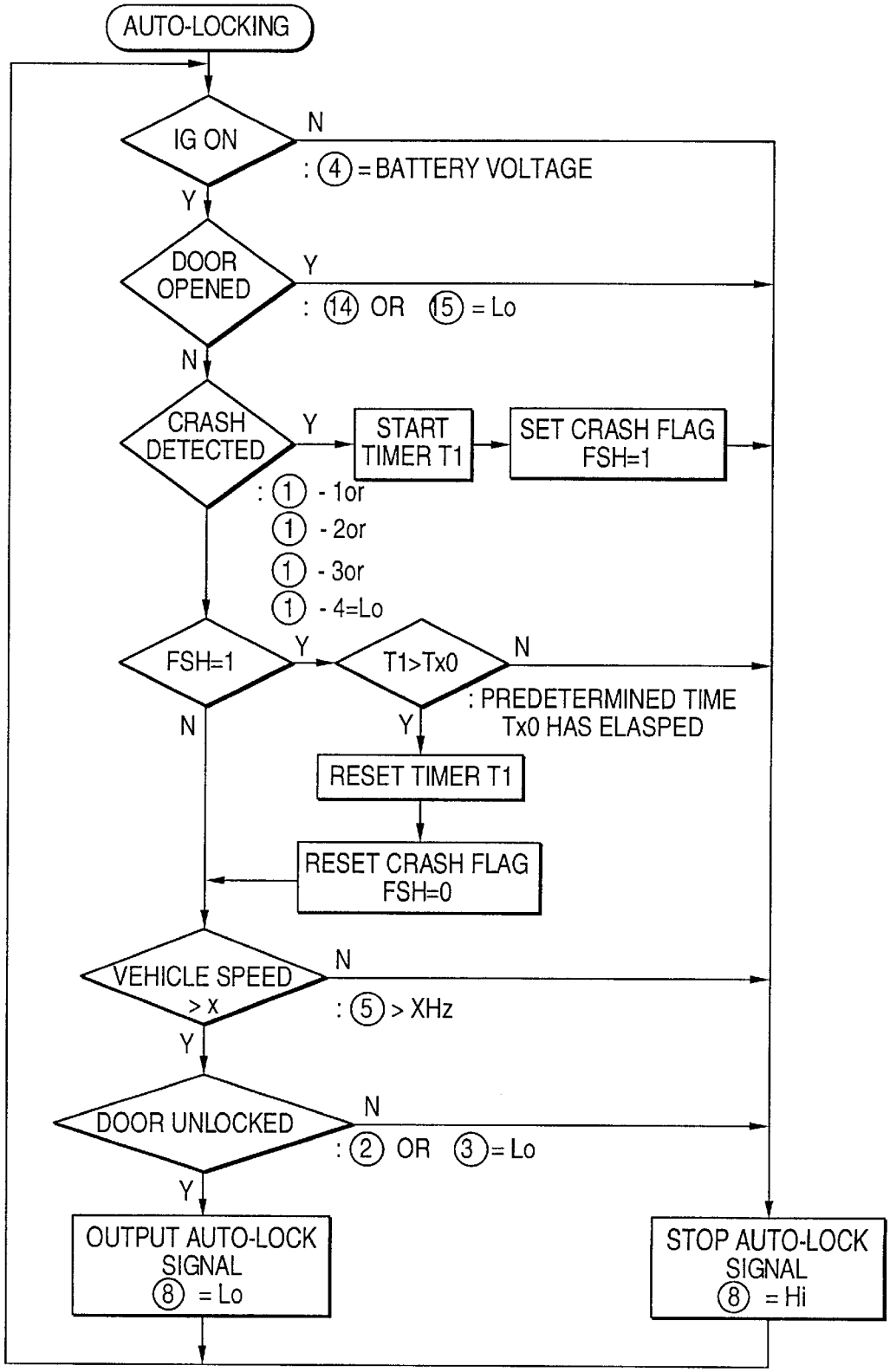
FIG. 12 is a flowchart showing the auto-locking control in the apparatus according to the fourth embodiment.
Figure 13:
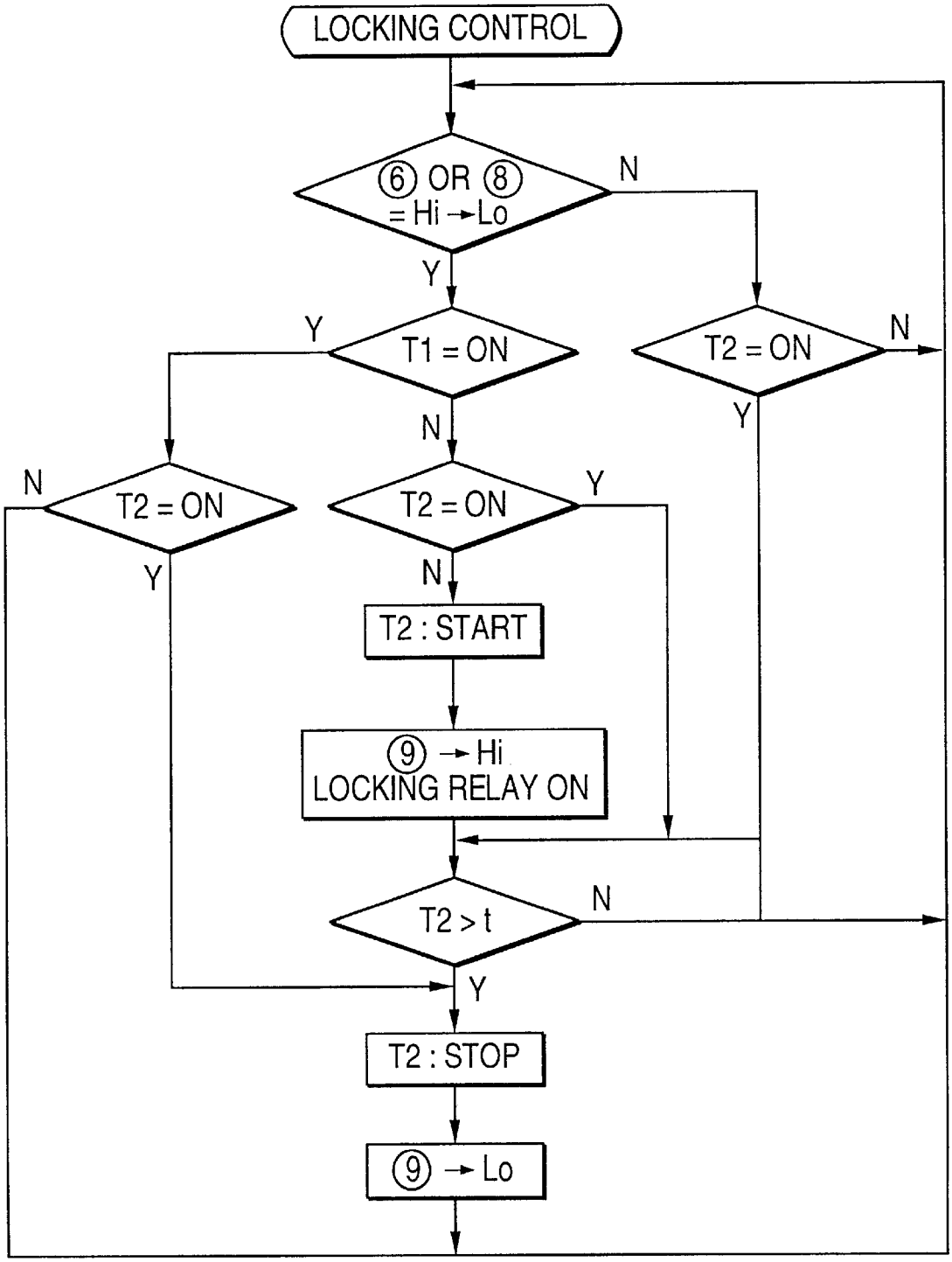
FIG. 13 is a flowchart showing the locking control in the apparatus according to the fourth embodiment.
Figure 14:
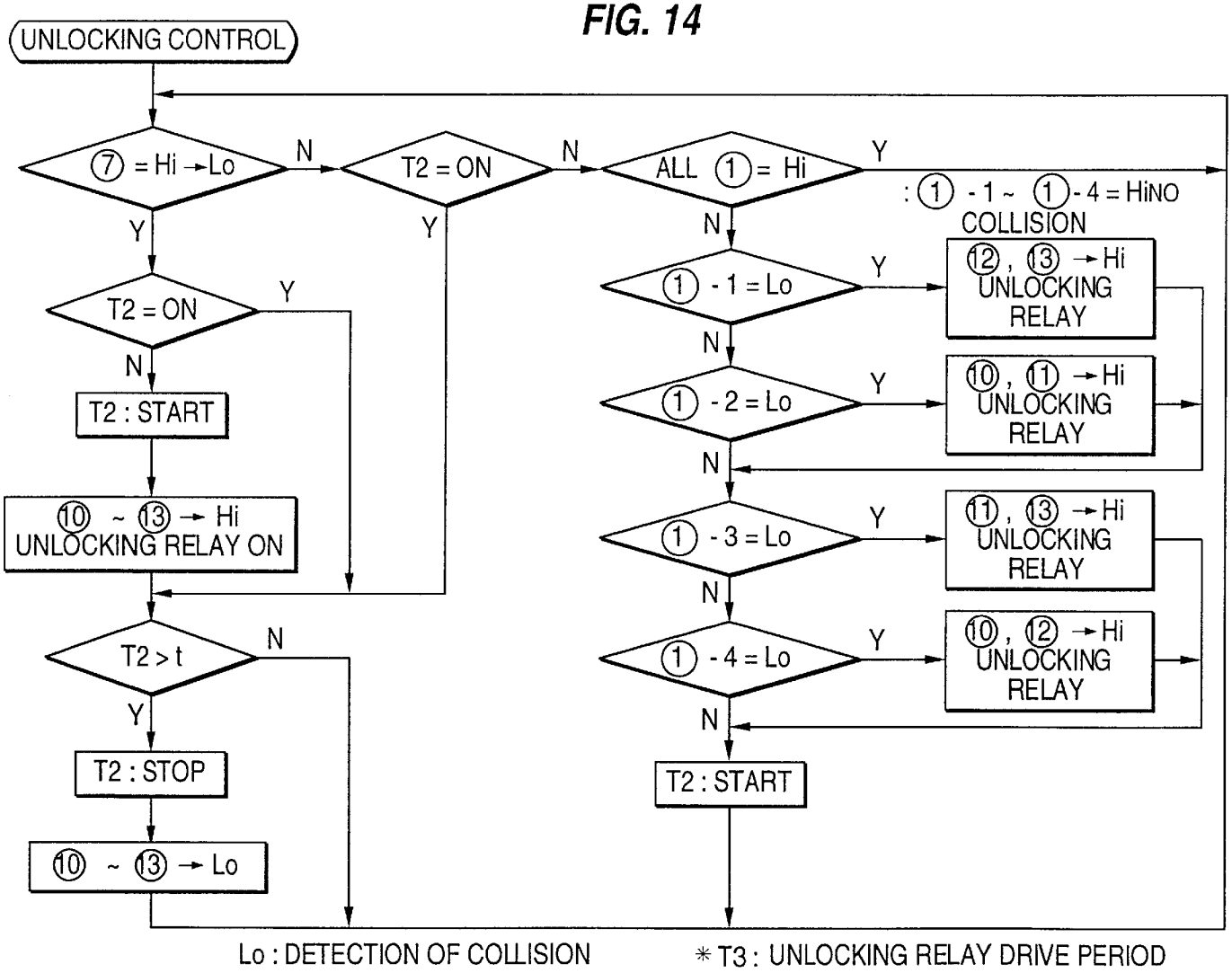
FIG. 14 is a flowchart showing the unlocking control in the apparatus according to the fourth embodiment.

The controller 251 is controlled in accordance with the auto-locking control flow shown in FIG. 12, the locking control flow shown in FIG. 13, and the unlocking control flow shown in FIG. 14.

Figure 15:
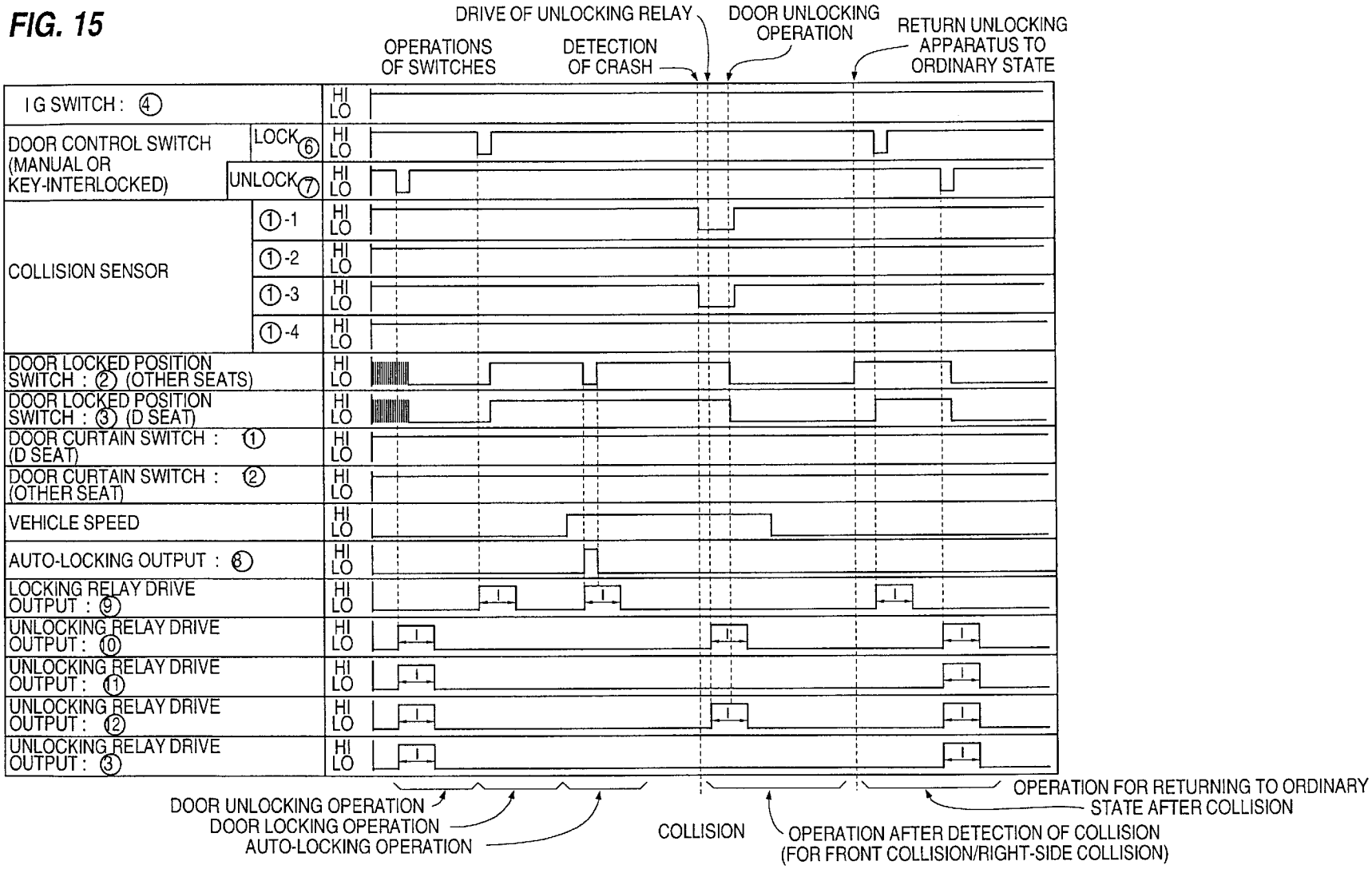
FIG. 15 is a time chart showing signals at various portions in the apparatus according to the fourth embodiment.
Figure 16:
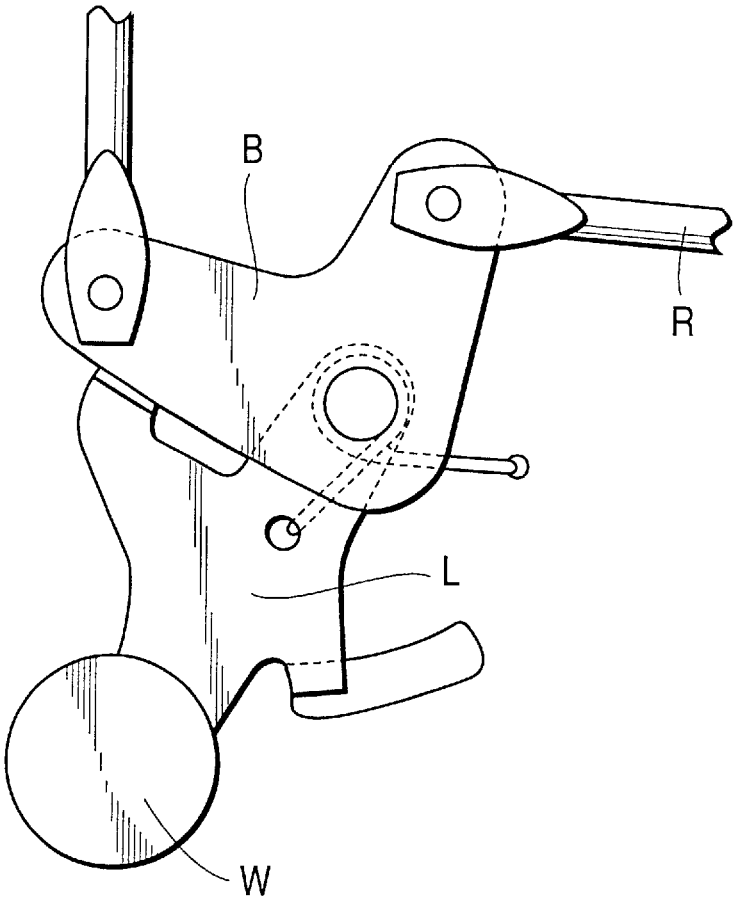
FIG. 16 (PRIOR ART)
FIG. 16 is a partial side view showing a conventional apparatus.

In the apparatus for unlocking a door lock for a vehicle according to the fourth embodiment, which has the above-described structure, the auto-locking control is performed as follows. As shown in FIGS. 12 and 15, an auto-locking signal is output when the ignition switch is turned on, each door is in the closed state, no collision has occurred, the vehicle speed has exceeded, for example, 25 km/h, and the door is in the unlocked state.

When the vehicle encounters a collision when the doors are in the locked state, the acceleration sensor 15 detects the direction of the impact acceleration of the collision, as shown in FIGS. 14 and 15. In accordance with the direction of the impact acceleration detected by the acceleration sensor 15, the controller 251 constituting the unlocking mechanism outputs an unlocking signal for unlocking a lock condition of a door located at a side opposite to the detected collision side. The door control motor 252 of that door responds to the unlocking signal from the controller 251 so as to unlock the door.

Specifically, as shown in FIGS. 14 and 15, in accordance with the output from the acceleration sensor which indicates the location of a collision, a relay of the relay section 2516 corresponding to the location of the collision outputs a signal so as to unlock a door lock located at a side opposite to the collision side.

In the apparatus for unlocking a door lock for a vehicle according to the fourth embodiment, which performs the above-described action, a door which is located at the front right, front left, rear right or rear left of the vehicle opposite to the collision side is unlocked electrically, based on the detection signal from the collision direction detecting means 1 for detecting front and back collisions as well as right-side and left-side collisions. Accordingly, the apparatus of the present embodiment has an effect of preventing a door from being opened due to the impact of a collision, and making it possible to smoothly and securely unlock a door lock located on a side opposite to the collision side, thereby making it possible to rescue vehicle occupants.

In the apparatus for unlocking a door lock for a vehicle according to the fourth embodiment, the controller 251 outputs an unlocking signal in accordance with the impact acceleration signal output from the acceleration sensor 15, and the door control motor 252 responds to the unlocking signal from the controller 251 so as to unlock the door lock located on the side opposite to the detected collision side. Accordingly, the apparatus according to the present embodiment has an effect of making it possible to unlock a door lock located on the side opposite to the collision side, only by adding the acceleration sensor to the electric door lock apparatus and by partially modifying the control program.

In the above-described fourth embodiment, a description is given of an example in which the acceleration sensor outputs a signal indicating the location of the vehicle at which a collision has occurred. However, the present invention is not limited to that example, and it is possible to employ an embodiment in which the controller obtains vector components based on acceleration signals from the acceleration sensor, and determines the location of a collision on the vehicle based on the vector components.

What is claimed is:

1. An apparatus for unlocking a door lock for any one of first and second doors provided respectively on opposite first and second side surfaces of a vehicle, comprising:

door locks mountable on the first and second doors of the vehicle and for locking said first and second doors;

collision direction detecting means for detecting an impact caused by a collision and applied to the first door on said first side surface of said vehicle; and an unlocking mechanism for unlocking a locked one of said door locks mounted on said second door on said second side surface opposite to the first door to which the impact is applied.

2. An apparatus for unlocking a door lock for a vehicle according to claim 1, wherein said collision direction detecting means detects an impact on the front side or rear side of the vehicle.

3. An apparatus for unlocking a door lock for a vehicle according to claim 1, wherein said collision direction detecting means detects an impact on the left side or right side of the vehicle.

4. An apparatus for unlocking a door lock for a vehicle according to claim 1, wherein said collision direction detecting means comprises a collision detecting mechanism including a plurality of movable members corresponding to each of the opposite first and second side surfaces, at each of which a collision will occur, each of the movable members being movable due to the impact caused by a collision of the vehicle, and wherein the movement of each said movable member is transmitted to said unlocking mechanism located at the second side surface.

5. An apparatus for unlocking a door lock for a vehicle according to claim 4, wherein each of said movable members comprises a swing member having a weight functioning as an inertia mass at the time of a collision of said vehicle, the swing member being swingable about a single supporting point in the direction of an inertial force opposite to the direction of the impact of the collision.

6. An apparatus for unlocking a door lock for a vehicle according to claim 1, wherein said collision direction detecting means comprises an acceleration sensor for detecting the direction of an impact acceleration when a collision of the vehicle occurs.

7. An apparatus for unlocking a door lock for a vehicle according to claim 6, wherein said unlocking mechanism comprises a controller which outputs, in accordance with the direction of the impact acceleration detected by said acceleration sensor, an unlocking signal for unlocking a lock condition of a door lock located on a side opposite to a collision side, and a door control motor which responds to the unlocking signal from said controller so as to unlock the door lock located on the side opposite to the collision side.

8. An apparatus for unlocking a door lock for a vehicle according to claim 5, wherein said swing member comprises a door lock knob, having a weight functioning as a inertia mass, for being provided in each of said doors of said vehicle.

9. An apparatus for unlocking a door lock for a vehicle according to claim 8, wherein said unlocking mechanism comprises a bell crank connected to said door lock knob and transmitted a movement of said door lock knob to a door lock when a collision occurs.

10. An apparatus for unlocking a door lock for a vehicle according to claim 5, wherein the doors provided respectively on opposite first and second side surfaces of the vehicle include front and rear doors, said swing member comprising a lock lever having a weight functioning as an inertia mass in a door lock of each of the front and rear doors.

11. An apparatus for unlocking a door lock for a vehicle according to claim 5, wherein said swing member comprises a bell crank, having a weight functioning as an inertia mass, connected to a lock lever of a door lock.

12. An apparatus for unlocking a door lock for a vehicle according to claim 7, wherein said controller comprises an auto-locking control section for outputting an auto-locking signal, a locking control section for outputting a locking signal or a collision signal and an unlocking control section for outputting an unlocking signal, a switch section connected to said locking and releasing control sections, and a relay section connected to said switch sections and the door control motor.

13. An apparatus for unlocking a door lock for a vehicle according to claim 12, further comprising:

a vehicle speed sensor, a parking brake switch and a door control switch respectively connected to said controller.

14. An apparatus for unlocking a door lock for a vehicle according to claim 13, wherein said unlocking control section comprises means for outputting an unlocking relay drive output having a constant pulse width in accordance with the direction of the impact acceleration detected by said acceleration sensor.

15. An apparatus for unlocking a door lock for a vehicle according to claim 4, wherein one of said movable members of said collision detecting mechanism, provided at said second door on said second side surface opposite to said first door, is movable.

16. An apparatus for unlocking a door lock for a vehicle according to claim 15, wherein a second of said movable members of said collision detecting mechanism, provided at said first door provided on said first side surface to which the impact is applied, is locked.

17. An apparatus for unlocking a door lock for a vehicle according to claim 5, wherein a line connecting said single supporting point of said swing member and a center of said inertia mass, intersects the direction of said inertial force of said inertia mass.

18. An apparatus for unlocking a door lock for a vehicle according to claim 4, wherein a line connecting said single supporting point of said swing member and a center of said inertia mass is at substantially a right angle to the direction of said inertial force of said inertia mass.

19. An apparatus for unlocking a door lock for a vehicle according to claim 4, wherein said movable member of said collision detecting mechanism provided at said second door is moved in a direction from outside to inside of said vehicle.

20. An apparatus for unlocking a door lock for a vehicle according to claim 18, wherein said movable member of said collision detecting mechanism at said second door is moved in a direction from inside to outside of said vehicle.

* * * * *